US006358137B1

(12) United States Patent
Threlfall

(10) Patent No.: US 6,358,137 B1
(45) Date of Patent: Mar. 19, 2002

(54) LABORATORY FUME HOOD CONTROL APPARATUS HAVING ROTARY SASH DOOR POSITION SENSOR

(75) Inventor: R. Gorden Threlfall, Hoffman Estates, IL (US)

(73) Assignee: Siemens Building Technologies, Inc., Buffalo Grove, IL (US)

( * ) Notice: Subject to any disclaimer, the term of this patent is extended or adjusted under 35 U.S.C. 154(b) by 0 days.

(21) Appl. No.: 09/550,455

(22) Filed: Apr. 17, 2000

(51) Int. Cl.[7] ..... B08B 15/02
(52) U.S. Cl. ..... 454/61; 49/14
(58) Field of Search ..... 454/56, 61; 49/14

(56) References Cited

U.S. PATENT DOCUMENTS

| | | | | | |
|---|---|---|---|---|---|
| 4,155,289 | A | * | 5/1979 | Garriss | 454/61 |
| 4,528,898 | A | | 7/1985 | Sharp et al. | 454/61 |
| 4,773,311 | A | | 9/1988 | Sharp | |
| 4,893,551 | A | | 1/1990 | Sharp et al. | |
| 5,090,304 | A | | 2/1992 | Egbers et al. | |
| 5,170,673 | A | | 12/1992 | Ahmed et al. | |
| 5,215,497 | A | | 6/1993 | Dress | 454/61 |
| 5,312,297 | A | * | 5/1994 | Dieckert et al. | 454/61 X |
| 5,347,754 | A | | 9/1994 | Jacob | |
| 5,470,275 | A | | 11/1995 | Jacob et al. | |
| 5,882,254 | A | | 3/1999 | Jacob | |

FOREIGN PATENT DOCUMENTS

| | | | | |
|---|---|---|---|---|
| AU | 63730/90 B | * | 12/1991 | 454/61 |
| CH | 670-207 A | * | 5/1989 | 454/61 |

* cited by examiner

*Primary Examiner*—Harold Joyce
(74) *Attorney, Agent, or Firm*—Greer, Burns & Crain, Ltd.

(57) ABSTRACT

A fume hood control apparatus for controlling the flow of air through the fume hood in a manner whereby the effective size of the total opening to the fume hood, including the portion of the opening that is not covered by one or more sash doors will have a relatively constant average face velocity of air moving into the fume hood. The apparatus includes a simple and reliable sash door sensing means for sensing the position of the moveable sash door by using a rotary position sensor with a lever arm mechanism which translates horizontal or vertical movement to rotary movement for determining the position of the sash door. The apparatus compensates for nonlinearity that result from the translation.

22 Claims, 8 Drawing Sheets

122
124
26
7
8
3
2
43
45
47
49
44
46
48
50
52
51
18
19
20
21
22
23
24
25
33
28
27
17
9 DO
10 D1
11 D2
12 D3
13 D4
14 D5
15 D6
16 D7
42
41
40
39
38
37
36
35
4
5
6
34
32
31
30
29
MC681K11
1
120
To 6a
To 6b
To 6d
+5V
+5V
RESIN
RESET
SENSE
RESET
CT
REF
GND

LABORATORY FUME HOOD CONTROL APPARATUS HAVING ROTARY SASH DOOR POSITION SENSOR

The present invention generally relates to the control of the ventilation of laboratory fume hoods and more particularly to an apparatus for controlling the flow of air through a laboratory fume hood to maintain a generally constant face velocity in the uncovered access opening in the front of the fume hood and which utilizes a rotary sensing device for determining the size of the uncovered portion of the access opening.

Fume hoods are used in various kinds of laboratory environments for providing a work place where potentially dangerous chemicals are used. The fume hoods generally comprise an enclosure having at least one movable door that is adapted to cover a front access opening to permit a person to gain access to the interior of the enclosure to conduct experiments and the like. The enclosure is typically connected to an exhaust system for removing any nauseous fumes so that the person will not be exposed to them while performing work in the hood. The sash doors of such fume hoods are designed to be opened either vertically or horizontally and the position of the doors is often referred to as the sash position.

Fume hood controllers that control the flow of air through the fume hood enclosures have become highly sophisticated and are now able to accurately maintain the desired flow characteristics to efficiently exhaust the fumes from the enclosure as a function of the desired average face velocity in the uncovered opening of the fume hood. The average face velocity is generally defined as the flow of air into the fume hood per square foot of open face area of the front access opening of the fume hood, with the size of the open face being dependent upon the position of the sash door or doors. It is highly desirable to minimize the flow of air through the fume hood while providing sufficient flow to ensure a safe environment. It is desirable to minimize the flow for the reason that it is necessary to replenish the air in the room in which the fume hood is located as air is exhausted through the fume hood exhaust duct and the replenishing air must necessarily be conditioned, with such conditioning carrying an attendant cost.

Fume hoods are exhausted by an exhaust system that typically includes a blower that is often capable of being driven at variable speeds to increase or decrease the flow of air from the fume hood to compensate for the varying size of the access opening. Alternatively, there may be a single blower that may or may not be of the type which is driven at variable speeds connected to the exhaust manifold that is in turn connected to individual ducts of multiple fume hoods, and dampers may be provided in the individual ducts to control the flow from the individual fume hoods to the exhaust manifold for the purpose of modulating the flow to maintain the desired average face velocity.

During operation of the fume hood controller, the principal variable that affects the amount of flow through the fume hood is the position of the sash door in the access opening that is typically in the front of the enclosure of the fume hood. Fume hoods may have multiple doors, some of which may be moved horizontally or vertically or both. There have been elaborate electromechanical mechanisms which are installed on the fume hood and sash doors for determining the position of the doors in a reliable manner so that the controller can determine the amount of uncovered area that exists in the access opening at any specific time. When a laboratory worker changes the position of the sash door, there can be a very rapid change in the area of the uncovered access opening which requires the air flow to be dramatically increased to maintain a constant face velocity in the hood. When the sash position is rapidly changed, there is a necessary lag in the system to alter the flow to return the system to its desired average face velocity and the recovery time is a function of the dynamics of the system, including the ability of the sash position sensing portion of the system to provide the correct input to the controller circuitry for the purpose of determining the size of the uncovered opening.

Previously known mechanisms for determining the position of the sash doors have included a relatively elaborate linkage means that was connected to the sash door and rode along a track which varied the resistance value as a function of the position of the sash door. While such an apparatus was reliable, it was located on the front of the cabinet and therefore exposed and vulnerable to being damaged over time. Another prior art mechanism utilized a potentiometer with a string which was connected to the sash and the potentiometer moved through multiple revolutions as the sash door was moved between its fully opened and closed positions. Such a mechanism was often unable to react with sufficient speed and sometimes jammed when a sash door was rapidly moved. This detrimentally affected the response time of the system to regain the desired average face velocity.

Accordingly, it is a primary object of the present invention to provide an improved fume hood controller that can selectively control the flow of air through the fume hood and which utilizes a sash position sensor that is extremely reliable and fast-acting in its operation.

Another object of the present invention is to provide such an improved controller that utilizes a simple acting rotary position sensor that is mounted to the fume hood and which has a simple linkage with the sash door so that an electrical value can be generated that is proportional to the position of the sash door.

Still another object of the present invention is to provide such a controller which is preferably mounted near the top of the fume hood adjacent the door so that electrical signals can be generated that are indicative of the position of the sash door, but which is out of the way from traffic and exposure to physical abuse during normal operation.

Yet another object of the present invention is to provide such an apparatus that is comprised of a relatively few number of parts and which has a simple design which facilitates its installation on laboratory fume hoods of a wide range of designs.

Another object of the present invention lies in the provision for compensating for nonlinearity that results from translating vertical or horizontal movement into rotary movement, with the apparatus of the present invention being capable of compensating for such nonlinear translation to thereby provide signals that are accurately indicative of the size of the uncovered opening.

These and other objects will become apparent upon reading the following detailed description of the present invention, while referring to the attached drawings, in which.

Figure 6A:
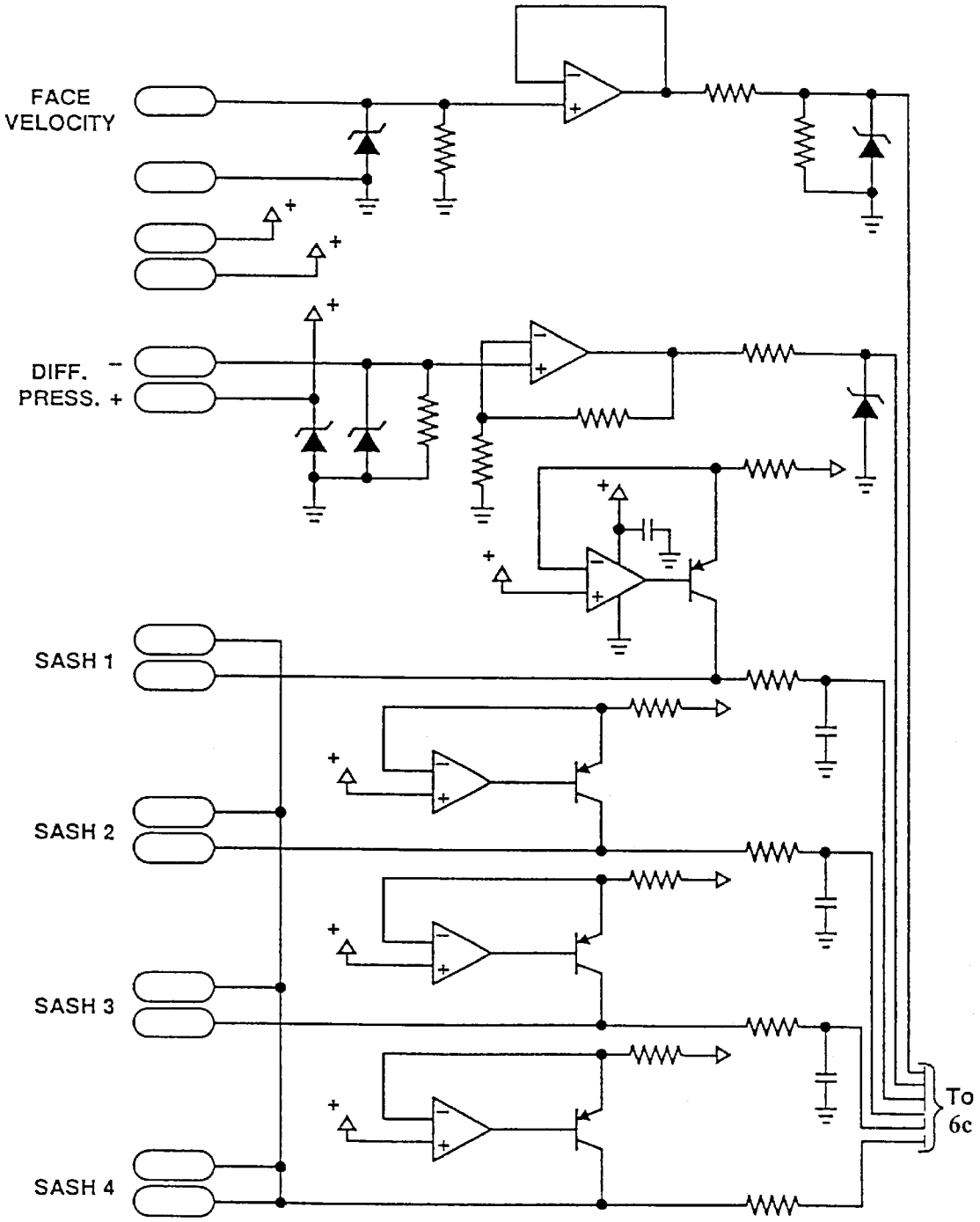
Figure 6B:
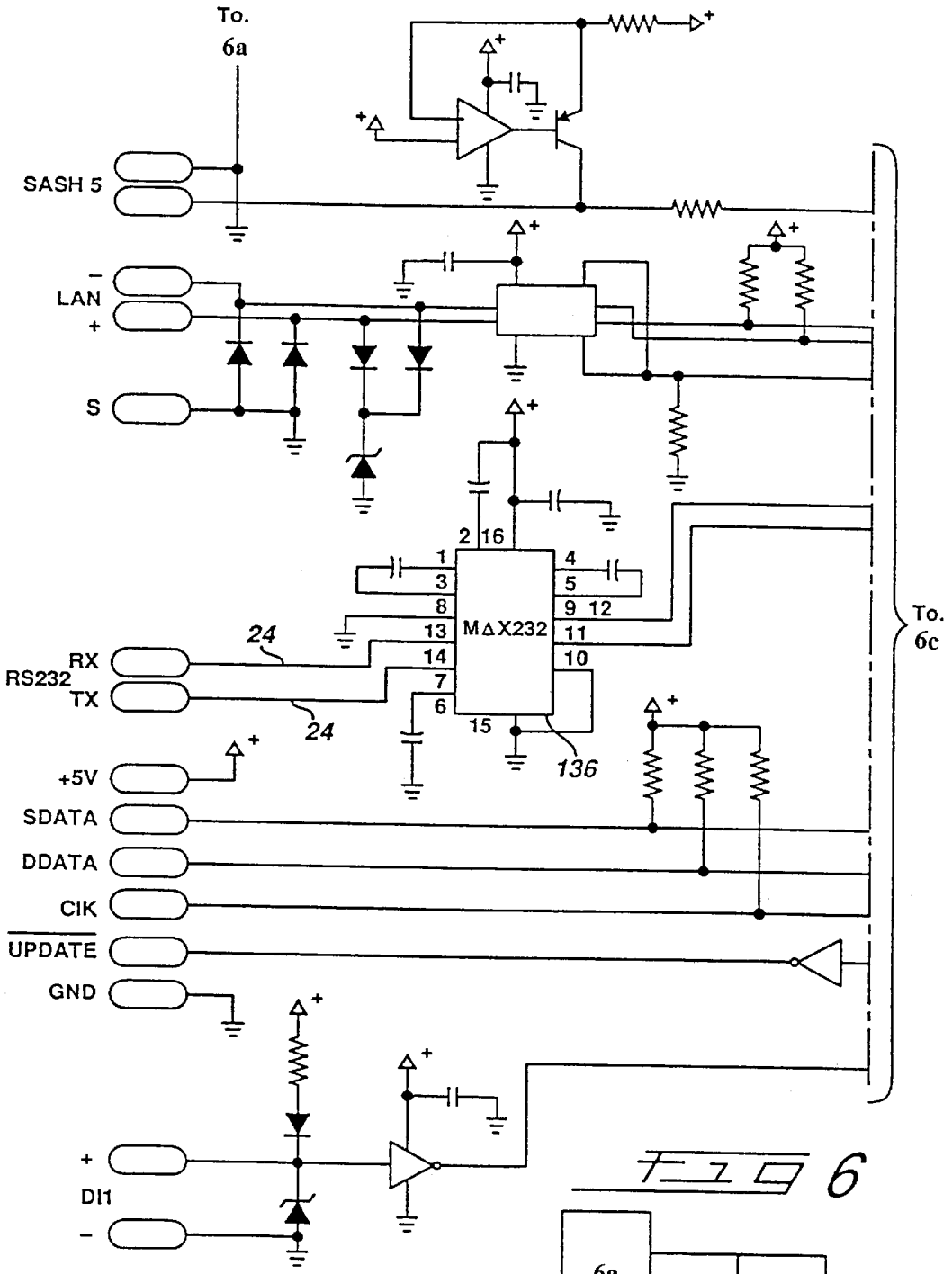
Figure 6:
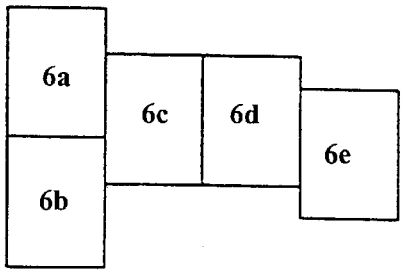

FIG. 6 is a block diagram illustrating the relative positions of FIGS. 6*a*, 6*b*, 6*c*, 6*d* and 6*e* to one another and which together comprise a schematic diagram of the electrical circuitry for the fume hood controller embodying the present invention; and, FIGS. 6*a*, 6*b*, 6*c*, 6*d* and 6*e*, which when connected together, comprise a schematic diagram of the electrical circuitry for the fume hood controller embodying the present invention.

DETAILED DESCRIPTION

It should be generally understood that a fume hood controller controls the flow of air through the fume hood in a manner whereby the effective size of the total opening to the fume hood, including the portion of the opening that is not covered by one or more sash doors will have a relatively constant average face velocity of air moving into the fume hood. This means that regardless of the area of the uncovered opening, an average volume of air per unit of surface area of the uncovered portion will be moved into the fume hood. This protects the persons in the laboratory from being exposed to noxious fumes or the like because air is always flowing into the fume hood, and out of the exhaust duct, and the flow is preferably controlled at a predetermined rate that can vary, but which is generally within the range of approximately 60 to 150 cubic feet per minute per square foot of effective surface area of the uncovered opening.

Broadly stated, the present invention is directed to a controller for a fume hood where the flow of air through the fume hood is controlled to maintain safe operating conditions and also to reduce the flow when possible to save costs. However, costs are not saved at the expense of safety, which is of paramount importance. The apparatus includes a simple and reliable sash door sensing means for sensing the position of the moveable sash door. The controller is adapted to control the flow of air through the fume hood as a function of the uncovered area of the access opening.

Figure 1:
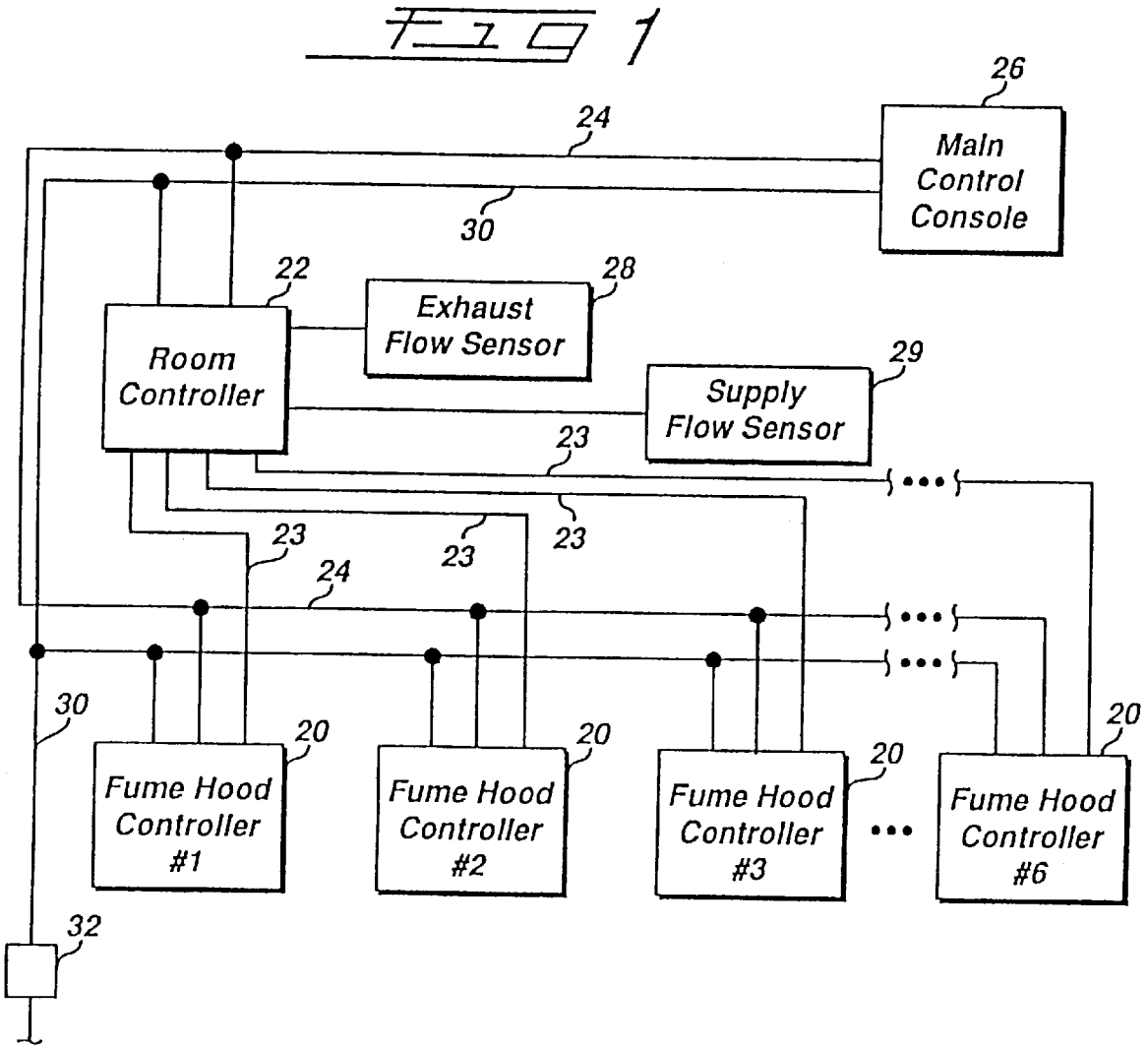
FIG. 1 is a schematic block diagram of apparatus of the present invention shown integrated with a room controller of a heating, ventilating, air conditioning, monitoring and control system of a building.

Turning now to the drawings, and particularly FIG. 1, a block diagram is shown of several fume hood controllers 20 interconnected with a room controller 22, an exhaust controller 24 and a main control console 26. The fume hood controllers 20 are interconnected with the room controller 22 and with the exhaust controller 24 and the main control console 26 in a local area network illustrated by line 28 which may be a multiconductor cable or the like. The room controller, the exhaust controller 24 and the main control console 26 are typically part of the building main HVAC system in which the laboratory rooms containing the fume hoods are located. The fume hood controllers 20 are provided with power through line 30, which is at the proper voltage via a transformer 32 or the like.

The room controller 22 preferably is of the type which is at least capable of providing a variable air volume to the room, and may be a Siemens Building Technologies laboratory room controller. The room controller 22 is capable of communicating over the LAN lines 28. The room controller is a commercially available controller for which extensive documentation exists. The Laboratory Control and Safety Solutions Design Guide Part No. 125-1931 for the Apogee LRC Laboratory Room Controller is specifically incorporated by reference herein.

The room controller 22 receives signals via lines 23 from each of the fume hood controllers 20 that provides an analog input signal indicating the volume of air that is being exhausted by each of the fume hood controllers 20 and a comparable signal from the exhaust flow sensor that provides an indication of the volume of air that is being exhausted through the main exhaust system apart from the fume hood exhausts.

Figure 2:
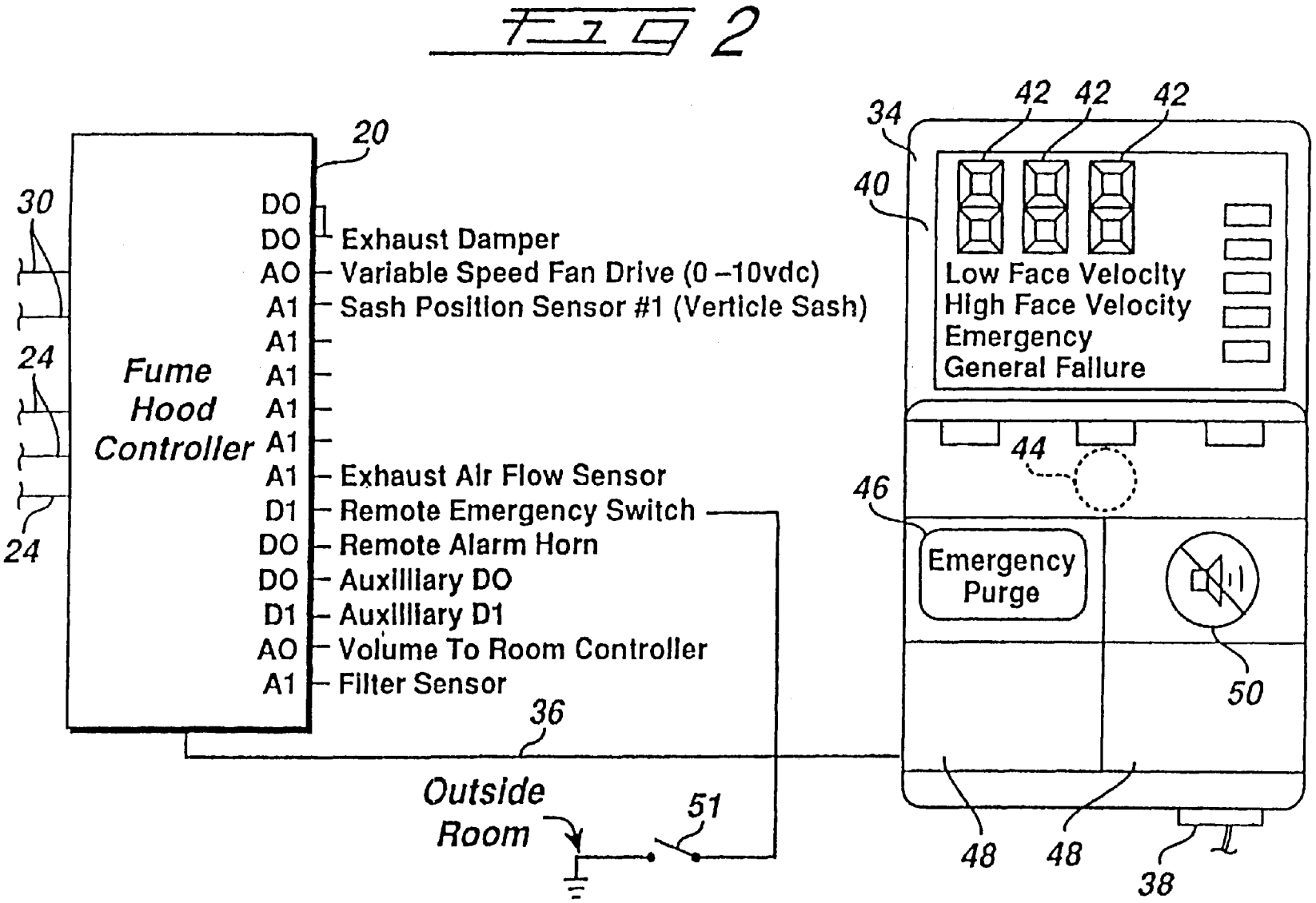
FIG. 2 is a block diagram of a fume hood controller shown connected to an operator panel, the latter being shown in front elevation.

Referring to FIG. 2, a fume hood controller 20 is illustrated with its input and output connector ports being identified, and the fume hood controller 20 is connected to an operator panel 34. It should be understood that each fume hood will have a fume hood controller 20 and that an operator panel will be provided with each fume hood controller. The operator panel 34 is provided for each of the fume hoods and it is interconnected with the fume hood controller 20 by a line 36 which preferably comprises a multi-conductor cable having eight conductors. The operator panel has a connector 38, such as a 6 wire RJ11 type telephone jack for example, into which a lap top personal computer or the like may be connected for the purpose of inputting information relating to the configuration or operation of the fume hood during initial installation, or to change certain operating parameters if necessary. The operator panel 34 is preferably mounted to the fume hood in a convenient location adapted to be easily observed by a person who is working with the fume hood.

The fume hood controller operator panel 34 preferably includes a liquid crystal display 40, which when selectively activated, provides the visual indication of various aspects of the operation of the fume hood, including three digits 42 which provide the average face velocity. The display 40 illustrates other conditions such as low face velocity, high face velocity and emergency condition and an indication of controller failure. The operator panel may have an audible alarm 44 and an emergency purge switch 46 which an operator can press to purge the fume hood in the event of an accident. The operator panel has two auxiliary switches 48 which can be used for various customer needs, including day/night modes of operation. It is contemplated that night time mode of operation would have a different and preferably reduced average face velocity, presumably because no one would be working in the area and such a lower average face velocity would conserve energy. An alarm silence switch 50 is also preferably provided to extinguish an alarm.

Fume hoods come in many different styles, sizes and configurations, including those which have a single sash door or a number of sash doors, with the sash doors being moveable vertically, horizontally or in both directions.

Figure 3:
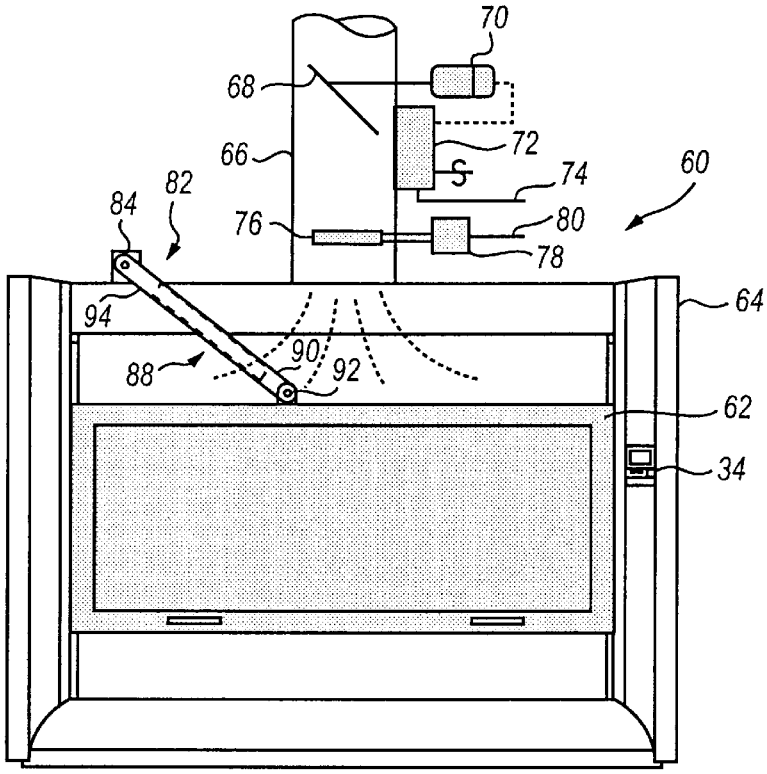
FIG. 3 is a diagrammatic elevation of the front of a representative fume hood having a vertically operable sash door.

Referring to FIG. 3, there is shown a fume hood, indicated generally at 60, which has a vertically operated sash door 62 (shown in a partially open condition), which can be moved to gain access to the fume hood.

The fume hood 60 has a generally enclosed cabinet 64 which is connected to an exhaust duct 66 that is used to remove air from the interior of the cabinet during operation. With the sash door 62 closed, the flow of air through the fume hood is at its minimum and generally comprises a residual flow that occurs through a bypass area which, while not shown, is typically located above the top portion of the sash door 62 as shown in the drawing. The flow of air through the fume hood is controlled by a damper 68 that is controlled by a damper actuator 70. The damper 70 is controlled by an analog output module that is connected to the fume hood controller 20 via line 74 and signals applied to this module from the controller enable the actuator to be controlled to vary the flow through the duct 66 in a controlled manner. An air flow sensor 76 is provided and is connected to a transmitter 78 that forwards signals indicative of the sensed air flow to the controller 20 via lines 80.

Figure 4:
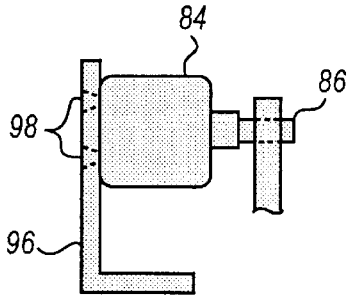
FIG. 4 is a left side elevation of a portion of the apparatus shown in FIG. 3, particularly illustrating the angular position sensor together with a portion of a lever arm.

In accordance with an important aspect of the present invention, the position of the sash door is sensed by a mechanism, indicated generally at 82, in FIGS. 3 and 4. Unlike the mechanism shown and described in the Jacob Patent 5,347,754, (assigned to the same assignee as the present invention) which comprises a relatively elaborate sliding mechanism mounted on the front or back of the doors along the path of movement, the present invention utilizes a mechanism 82 which translates linear movement of the sash door 26 into rotary movement. The rotary movement is sensed by a rotary position sensor 84 that has an output shaft 86 to which a lever arm, indicated generally at 88, is connected. The lever arm 88 has an opposite end piece 90 that is pivotally connected to the sash door 62 with a bracket 92 that is similar in design to bracket 96.

In the preferred embodiment, the lever arm 88 is comprised of two pieces, one of which is the piece 90 and the other of which is piece 94. The two pieces slidably engage one another so that the length of the lever arm 88 can be varied as the sash door is raised or lowered. This is necessary because of the fact that the vertical movement of the door effectively changes the length of the lever arm 88 through its travel. As shown in FIG. 4, the sensor 84 is mounted to a L-shaped bracket 96 via screws 98 or the like and the bottom of the bracket is similarly attached to a portion of the fume hood enclosure 64 in a similar fashion (not shown). While the length of the bracket 96 is relatively short, it could be much longer if it is preferred to place the sensor 84 at a different elevation. The important consideration is that the lever arm mechanism 88 be connected to the door sash in such a way that it does not interfere with the movement of the door, but enables an electrical value to be generated that is a function of the angular position of the shaft 86 so that the fume hood controller can have an input that is indicative of the amount of openness of the uncovered area of the access opening. While the embodiment shown in FIG. 3 has a sash door that moves in a vertical direction, it should be understood that horizontally moveable sash doors may have a similar mechanism 82 installed to detect the position of the sash door along a track.

It is preferred that the rotary position sensor be a potentiometer that has a range of electrical resistance through an arc of at least approximately 105 degrees. However, it should be understood that alternative rotary position sensors can be used, such as a contacting encoder such as that made by Bourns Model ECW1JB24-VC0024 or an optical encoder such as the Bourns Model No. ENS 1JB28L00256 or a rotary position sensor such as Model No. 961-0001 made by Spectrol. An advantage of the use of such rotary position sensors as contrasted with a potentiometer that is spring loaded and controlled by pulling on a string that is attached to a sash door is that moving the sash door 62 from its totally closed to open positions results in an angular rotation of less than approximately 90° for the position sensor 84 in contrast to multiple complete revolutions for the "potentiometer on a string" product that is used in the prior art. The multi-revolution rotational movement of the potentiometer on a string devices is not sufficiently responsive to a rapid opening or closing of the sash door, and they often experience binding problems which may cause a malfunction of the system.

Figure 5:
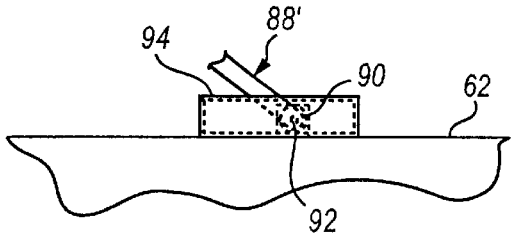
FIG. 5 is a front elevation of a modification of a portion of the apparatus shown in FIG. 3.

With the rotary position sensor 84 of the present invention, such binding problems do not exist and an immediate signal, in the form of an analog voltage or current, can be input to the microprocessor of the controller circuitry so that it can calculate the amount of openness of the access opening in the fume hood virtually immediately and thereby not impair the response time of the system. An alternative embodiment is shown in FIG. 5 which is shown to have a lever arm 88' that is connected to an internal wheel 90 via an axle 92, with the block being slidable in a bracket 94 having a side slot opening. The wheel 90 thereby rides in the bracket 94 and can move to the right or left as shown so that vertical movement of the sash door 62 will enable the arm to be rotated about the axis defined by the shaft 86 without the lever arm 88 being adjustable in length. It should be apparent that the length of the bracket 94 should be sufficient to enable movement from a completely closed to a completely opened position.

Referring to the composite electrical schematic diagram of the circuitry of the fume hood controller, if the separate drawings FIGS. 6*a*, 6*b*, 6*c*, 6*d* and 6*e* are placed adjacent one another in the manner shown in FIG. 6, the total electrical schematic diagram of the fume hood controller 20 is illustrated. The operation of the circuitry of FIGS. 6*a* through 6*e* will not be described in detail. While FIG. 6*a* illustrates sashes 1 through 4, only one of these inputs would be utilized for a single vertically moveable sash door such as is shown in FIG. 3. The circuitry is driven by a microprocessor and the important algorithms that carry out the control functions of the controller will be hereinafter described.

Figure 6C:
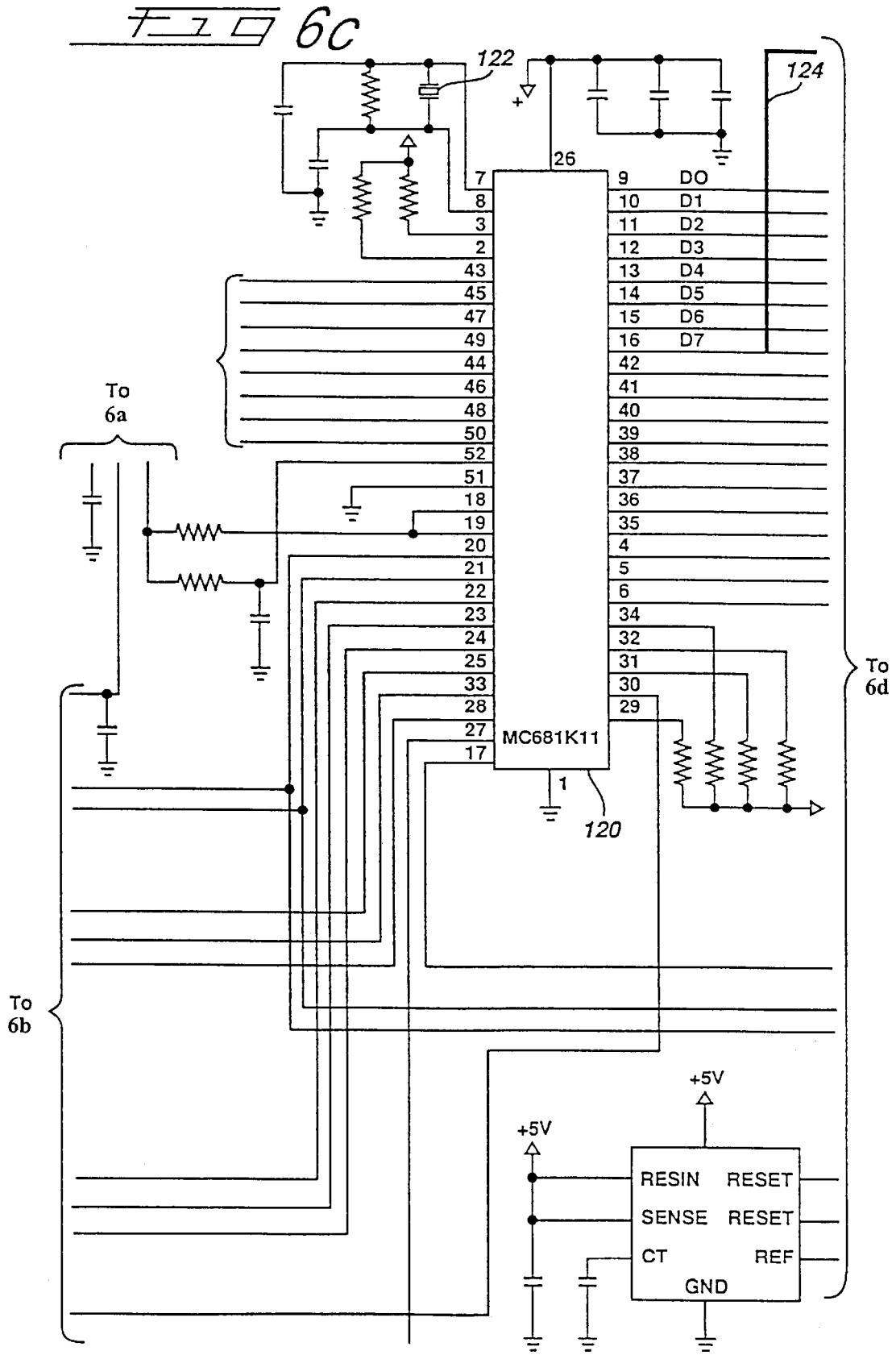
Figure 6D:
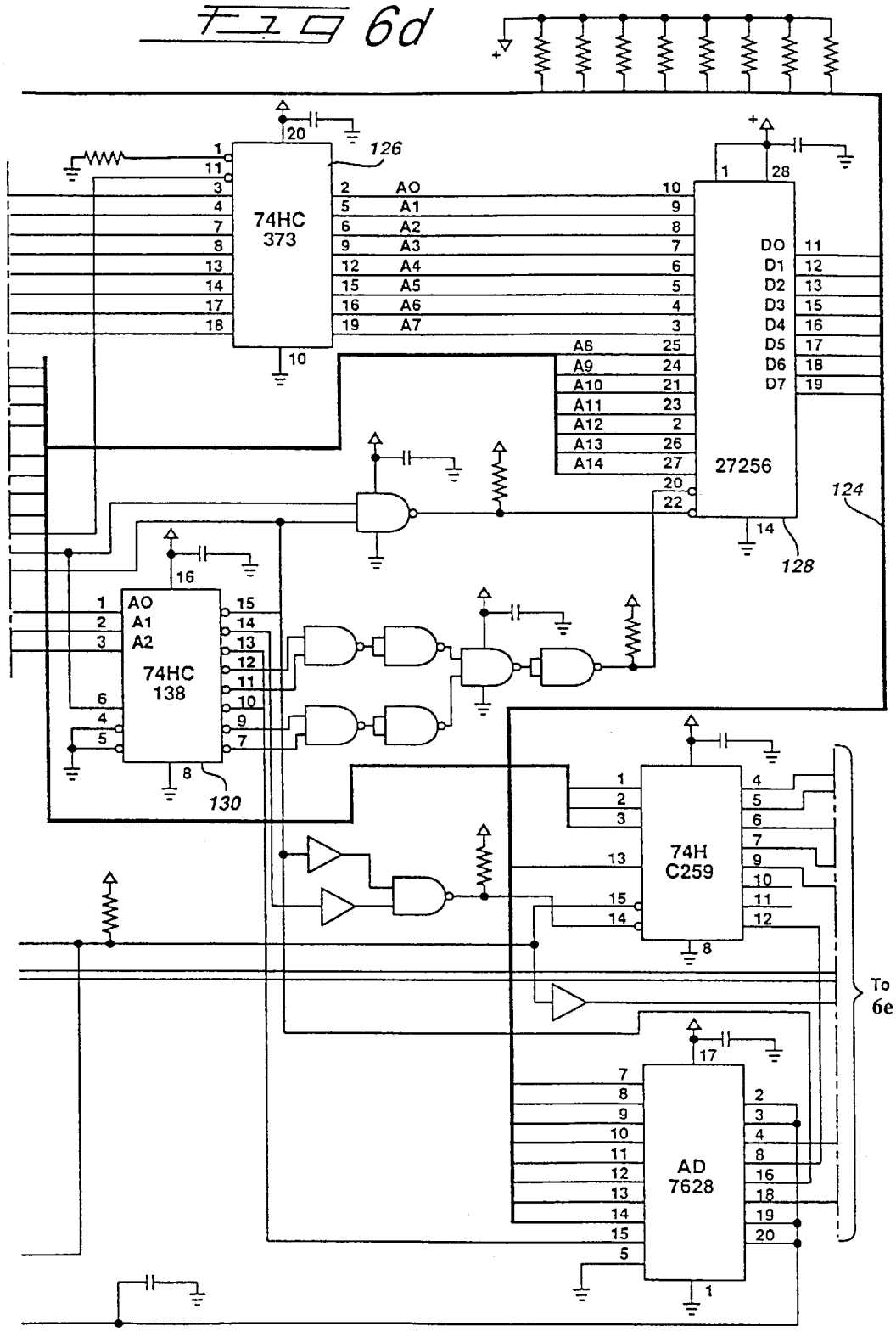
Figure 6E:
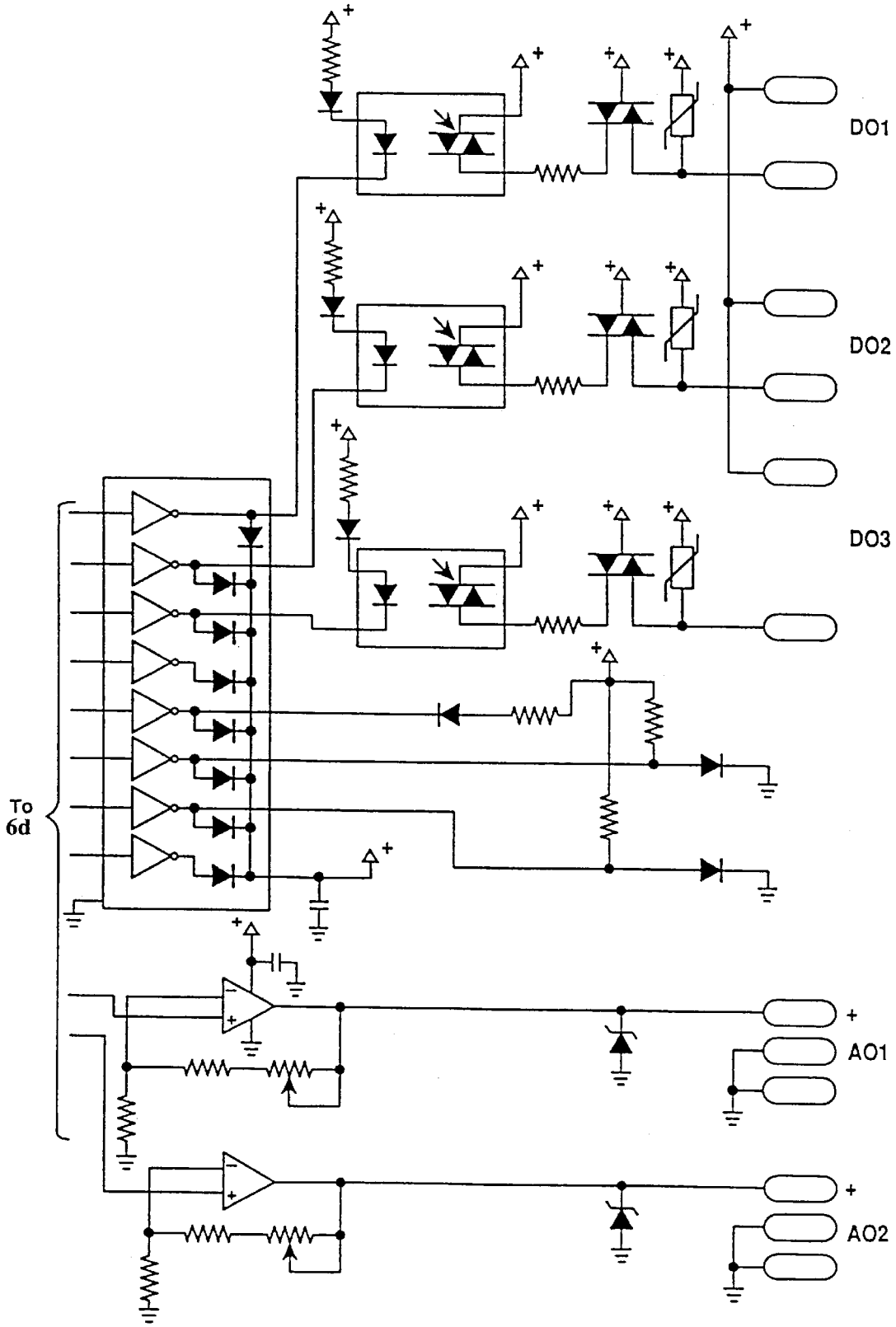

Referring to FIG. 6*c*, the circuitry includes a Motorola MC 68HC11 microprocessor 120 which is clocked at 8 MHz by a crystal 122. The microprocessor 120 has a databus 124 that is connected to a tri-state buffer 126 (FIG. 6d) which in turn is connected to an electrically programmable read only memory 128 that is also connected to the databus 124. The EPROM 128 has address lines A0 through A7 connected to the tri-state buffer 126 and also has address lines A8 through A14 connected to the microprocessor 120. The circuitry includes a 3 to 8-bit multiplexer 130, a data latch 132 (see FIG. 6*d*), a digital-to-analog converter 134, which is adapted to provide the analog outputs indicative of the volume of air being exhausted by the fume hood, which information is provided to room controller 22 as has been previously described with respect to FIG. 2. Referring to FIG. 6*b*, an RS232 driver 136 is provided for transmitting and receiving information through the hand held terminal. The other components are well known and therefore need not be otherwise described.

In accordance with another important aspect of the present invention, the apparatus of the present invention is adapted to make compensating corrections for any nonlinearity that results from translating vertical movement of the sash door to angular movement of the shaft of the rotary position sensor 84. Since either the embodiment of FIG. 3 with its adjustable length lever arm 88 or FIG. 5 with its horizontally movable connection of the lever arm 88' to the sash door 62, conversion of the vertical movement into rotary movement will necessarily be nonlinear through the full extent of the travel from a fully closed to a fully opened position. The present invention is adapted to compensate for such nonlinearity of translation by mapping a series of increments of travel with electrical values that are generated at known increments and thereafter interpolating values between points to obtain an accurate calculation of the uncovered opening during operation. Such data can be mapped into a lookup table that may include four to six or even more points and the data for the table can be stored in the memory of the microprocessor 120 shown in FIG. 6*c*.

From the foregoing, it should be understood that a fume hood controller has been shown and described which has many advantages and attributes relative to the prior art. The simple and effective rotary position sensor and mechanism is highly reliable and simple in its operation. The capability of the system to compensate for nonlinear translation of vertical to rotary movement of the sash door enables an accurate calculation of the uncovered opening to be made.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for sensing the position of a sash door that is adapted to cover an access opening in a cabinet of a laboratory fume hood, the sash door being moveable between a closed and an open position, said apparatus generating an electrical signal that is proportional to the size of the uncovered opening, said apparatus comprising:

a rotary position sensor coupled to the fume hood and for providing an electrical value that varies as a function of to angular position of a rotatable mechanical shaft;

a linear to rotary motion translation mechanism operably attached to said shaft and to the sash door wherein moving the sash door between its closed and fully open positions rotates said shaft through a predetermined angular arc of no greater than 360°, thereby producing said electrical value that is proportional to the size of the uncovered opening.

2. Apparatus as defined in claim 1 wherein said mechanism includes a lever and the length of said lever between points of attachment to said shaft and the sash door is adjustable.

3. Apparatus as defined in claim 2 wherein said lever comprises at least two components that are slidably coupled together.

4. Apparatus as defined in claim 1 wherein said rotary position sensor comprises a rotary contacting encoder.

5. Apparatus as defined in claim 1 wherein said rotary position sensor comprises a rotary potentiometer.

6. Apparatus as defined in claim 1 wherein said rotary position sensor comprises a rotary optical encoder.

7. Apparatus as defined in claim 1 wherein said rotary position sensor is coupled to the fume hood by a bracket attached to the enclosure and adapted to carry said sensor.

8. Apparatus as defined in claim 1 wherein said electrical value is a resistance value.

9. Apparatus as defined in claim 1 wherein the sash door is vertically moveable between its open and closed position.

10. Apparatus as defined in claim 9 wherein said mechanism includes a lever having an elongated member and a slidable pivot bracket, said elongated member having one end portion attached to said shaft and an opposite end portion connected to said slidable pivot bracket, said pivot bracket permitting said opposite end portion to move horizontally during vertical movement of the sash door between said open and closed positions.

11. Apparatus for controlling air flow through a laboratory fume hood to maintain a predetermined average ace velocity through an uncovered portion of an access opening, the fume hood being in communication with an exhaust duct for expelling air and fumes from the fume hood in an amount that is measured by the average face velocity primarily through the access opening, the fume hood being of the type which has a generally closed cabinet with the access opening being located in the front thereof, the fume hood having at least one moveable sash door adapted to cover the opening, said apparatus sensing the position of the sash door as it is positioned between a closed and an open position and generating an electrical value that is proportional to the size of the uncovered opening, said apparatus comprising:

a rotary position sensor coupled to the fume hood for providing an electrical value that varies as a function of the angular position of a rotatable mechanical shaft;

a linear to rotary motion translation mechanism operably attached to said shaft and to the sash door wherein moving the sash door between its closed and fully open positions rotates said shaft through a predetermined angular arc of no greater than 360°, thereby producing said electrical value that is proportional to size of the uncovered opening;

a circuit for receiving one of said electrical values between said open and closed positions and adjusting said values for nonlinearities that result from translating vertical motion of the sash door to rotary motion of said shaft.

12. Apparatus as defined in claim 11 wherein said mechanism includes a lever and the length of said lever between points of attachment to said shaft and sash door is adjustable.

13. Apparatus as defined in claim 12 wherein said lever comprises at least two components that are slidably coupled together.

14. Apparatus as defined in claim 11 wherein said rotary position sensor comprises a rotary contacting encoder.

15. Apparatus as defined in claim 11 wherein said rotary position sensor comprises a rotary potentiometer.

16. Apparatus as defined in claim 11 wherein said sensor comprises a rotary optical encoder.

17. Apparatus as defined in claim 11 wherein said rotary position sensor is coupled to the fume hood by a bracket attached to the enclosure and adapted to carry said sensor.

18. Apparatus as defined in claim 11 wherein said electrical value is a resistance value.

19. Apparatus as defined in claim 11 wherein said circuit includes a processor operably connected to said rotary position sensor and adapted to receive electrical signals that are proportional to said electrical values, said processor including an electronic storage device for storing a plurality of said electrical signal values corresponding to various positions between said open and closed positions for interpolating electrical signal values throughout the range of positions between said open and closed positions.

20. Apparatus as defined in claim 11 wherein the sash door is vertically moveable between its open and closed position.

21. Apparatus as defined in claim 20 wherein said mechanism includes a lever having an elongated member and a slidable pivot bracket, said elongated member having one end portion attached to said shaft and an opposite end portion connected to said slidable pivot bracket, said pivot bracket permitting said opposite end portion to move horizontally during vertical movement of the sash door between said open and closed positions.

22. A laboratory fume hood to maintain a predetermined average face velocity through an uncovered portion of an access opening, the fume hood being in communication with an exhaust duct for expelling air and fumes from the fume hood in an amount that is measured by the average face velocity primarily through the access opening, the fume hood comprising:

a generally closed cabinet with the access opening being located in the front thereof, at least one moveable sash door adapted to cover the opening;

an airflow control apparatus for sensing the position of the sash door as it is positioned between a closed and an open position and generating an electrical value that is proportional to the size of the uncovered opening, said apparatus having;

a rotary position sensor coupled to the fume hood for providing an electrical value that varies as a function of angular position of a rotable mechanical shaft;

a linear to rotary motion translation mechanism operably attached to said shaft and to the sash door wherein moving the sash door between its closed and fully open positions rotates said shaft through a predetermined angular arc of no greater 360°, thereby producing said electrical value that is proportional to the size of the uncovered opening; and a circuit for receiving one of said electrical values between said open and closed positions and adjusting said values for nonlinearities that result from translating vertical motion of the sash door to rotary motion of said shaft.

* * * * *

UNITED STATES PATENT AND TRADEMARK OFFICE

CERTIFICATE OF CORRECTION

PATENT NO. : 6,358,137 B1
DATED : March 19, 2002
INVENTOR(S) : R. Gorden Threlfall It is certified that error appears in the above-identified patent and that said Letters Patent is hereby corrected as shown below:

Column 3,
Lines 45-46, delete “, an exhaust controller 24”; after “26.” insert -- The room controller 22 is also connected to an exhaust flow sensor 28 and a supply flow sensor 29. --
Line 48, delete “and with the exhaust controller 24”.
Line 49, delete “28” and insert -- 24 --.
Line 51, delete “, the exhaust controller 24”.
Line 62, delete “28” and insert -- 24 --.

Column 4,
Line 64, after “damper” insert -- actuator --.
Line 65, after “module” insert -- 72 --.

Column 5,
Line 14, delete “26” and insert -- 62 --.
Line 51, change “ENS 1JB28L00256” to -- ENS1JB28L00256 --.

Column 6,
Line 29, after “Motorola” insert -- MC681K11 (shown) or alternatively may include a Motorola --.

Column 7,
Line 29, delete “to” and insert -- the --.

Column 8,
Line 2, delete “ace” and insert -- face --.

Signed and Sealed this

Twenty-first Day of January, 2003

JAMES E. ROGAN
*Director of the United States Patent and Trademark Office*